US009382745B2

(12) United States Patent
Plummer

(10) Patent No.: US 9,382,745 B2
(45) Date of Patent: Jul. 5, 2016

(54) POWERED SASH DRIVING APPARATUS HAVING A CONNECTION BLOCK

(71) Applicant: Andersen Corporation, Bayport, MN (US)

(72) Inventor: David D. Plummer, Hudson, WI (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 14/557,586

(22) Filed: Dec. 2, 2014

(65) Prior Publication Data

US 2015/0152676 A1 Jun. 4, 2015

Related U.S. Application Data

(60) Provisional application No. 61/911,100, filed on Dec. 3, 2013.

(51) Int. Cl.

| | |
|---|---|
| ***E05F 15/603*** | (2015.01) |
| ***E05F 1/00*** | (2006.01) |
| ***E05C 1/08*** | (2006.01) |
| ***E05D 13/00*** | (2006.01) |
| ***E05F 15/665*** | (2015.01) |
| *E05D 15/16* | (2006.01) |

(52) U.S. Cl.

CPC ..... *E05F 15/603* (2015.01); *E05C 1/08* (2013.01); *E05D 13/1207* (2013.01); *E05F 1/00* (2013.01); *E05F 15/665* (2015.01); *E05D 15/16* (2013.01)

(58) Field of Classification Search

CPC ..... E05F 11/35; E05F 11/40; E05F 11/53; E05F 15/632; E05F 15/652; E05F 15/665; E05F 15/673; E05D 13/12; E05D 13/1207; E05D 13/1253

See application file for complete search history.

(56) References Cited

U.S. PATENT DOCUMENTS

| | | | | |
|---|---|---|---|---|
| 4,409,905 | A * | 10/1983 | Zerbi | 105/149.1 |
| 5,152,032 | A | 10/1992 | Davis et al. | |
| 5,301,734 | A * | 4/1994 | Opel | 160/100 |
| 5,440,837 | A * | 8/1995 | Piltingsrud | 49/139 |
| 5,826,377 | A * | 10/1998 | Simson et al. | 49/362 |
| 6,115,884 | A | 9/2000 | DeJong et al. | |
| 6,948,215 | B2 | 9/2005 | Malek et al. | |
| 7,410,201 | B1 * | 8/2008 | Wilson et al. | 296/146.16 |
| 7,574,772 | B2 | 8/2009 | Wellman et al. | |
| 8,156,838 | B2 | 4/2012 | Batosky et al. | |
| 8,393,237 | B2 | 3/2013 | Arenz et al. | |
| 8,474,185 | B2 * | 7/2013 | Busch | 49/358 |
| 2004/0244295 | A1 * | 12/2004 | Derham et al. | 49/362 |
| 2006/0150520 | A1 * | 7/2006 | Hamazaki | 49/449 |
| 2007/0011946 | A1 * | 1/2007 | Mullen et al. | 49/325 |
| 2007/0234644 | A1 * | 10/2007 | Jaeger et al. | 49/362 |
| 2009/0025296 | A1 * | 1/2009 | Petner | 49/130 |
| 2010/0122493 | A1 | 5/2010 | Burrows | |

FOREIGN PATENT DOCUMENTS

| | | | |
|---|---|---|---|
| GB | 421433 | * | 12/1934 |
| WO | WO 2008/047121 A1 | | 4/2008 |

* cited by examiner

*Primary Examiner* — Katherine Mitchell
*Assistant Examiner* — Catherine A Kelly
(74) *Attorney, Agent, or Firm* — Mueting, Raasch & Gebhardt, P.A.

(57) ABSTRACT

Windows including one or both of a powered sash driving apparatus and a window balance apparatus and further including a sash connector block and latch bolt assembly are described herein, along with methods of assembling and/or operating the windows.

12 Claims, 9 Drawing Sheets

POWERED SASH DRIVING APPARATUS HAVING A CONNECTION BLOCK

CROSS-REFERENCE TO RELATED APPLICATIONS

The present application claims priority under 35 U.S.C. §119 to U.S. Provisional Application Ser. No. 61/911,100 filed on Dec. 3, 2013, which is incorporated herein by reference in its entirety.

Windows with a powered sash driving apparatus operably connected to a connection block that is configured to reconnect with a latch bolt on a moving sash are described herein along with methods of assembling and/or operating the windows.

Window balances are used in windows with sashes that move vertically such as, e.g., double hung or single hung windows, to help offset the weight of the sash to a user moving the moving sash in the window. Conventional window balances use spring tension and/or gravity to help offset the weight of moving sashes within a window.

SUMMARY

Windows including a powered sash driving apparatus operably connected to a connection block that is configured to reconnect with a latch bolt on a moving sash are described herein along with methods of assembling and/or operating the windows.

The powered sash driving apparatus and connection blocks described herein can be used with windows in which the sash or sashes move vertically (as in, e.g., a double or single hung window) or they can be used in windows in which the sash or sashes moved generally horizontally (as in, e.g., a gliding or sliding window). In addition, although described in connection with the movement of one or more sashes within a window (either vertically in the case of a single or double hung window or horizontally in the case of a sliding or gliding window), the powered driving apparatus, connector blocks, and latch assemblies described herein may, in one or more embodiments, be used in other building components (e.g., doors, etc.) to provide translational motion to other moving panels such as, e.g., a panel of a sliding or gliding door, a pocket door, etc.

In one or more embodiments in which the powered sash driving apparatus and connection blocks are used in windows in which the sash or sashes move vertically, the window may include a window balance apparatus in addition to the powered sash driving apparatus as described herein. In one or more embodiments in which both a powered sash driving apparatus and a window balance apparatus are provided, the powered sash driving apparatus and window balance apparatus may be combined as described in various illustrative embodiments herein.

Including a powered sash driving apparatus in combination with a window balance apparatus in a window as described herein may, in one or more embodiments, provide a window which can be both manually operated and operated using a powered motor to move a sash within the window frame. In essence, the window balance apparatus assists the powered sash driving apparatus in moving the sash in a window by at least partially offsetting the weight of the sash. The sash can still be moved manually, i.e., in the absence of any assistance by the powered sash driving apparatus, which may be advantageous in the event of a power outage or other emergency when the powered sash driving apparatus is not working.

In one aspect, one or more embodiments of the windows described herein may include a window frame comprising first and second side jambs that are connected to each other by a head jamb and a sill; a sash movably mounted in the window frame, the sash positioned between the first and second side jambs and configured for movement between the head jamb and the sill along a first axis aligned with the first and second side jambs; a latch assembly attached to a first side of the sash, wherein the first side of the sash is adjacent to and moves along the first side jamb, wherein the latch assembly comprises a latch bolt movable between an extended position and retracted position, wherein the latch bolt is biased in the extended position in which the latch bolt extends away from the first side of the sash towards the first side jamb and wherein the latch bolt is movable from the extended position to the refracted position in which the latch bolt moves towards the first side jamb; and a window balance apparatus configured to counteract the weight of the sash during movement of the sash between the head jamb and the sill; a powered sash driving apparatus comprising a motor and a linear actuator; a sash connector block operably connected to the linear actuator of the powered sash driving apparatus, wherein the powered sash driving apparatus is configured to move the sash connector block along the first side jamb between the head jamb and the sill. In one or more embodiments, the sash connector block comprises: a head jamb end and a sill end, wherein the head jamb end is closer to the head jamb than the sill end and wherein the sill end is closer to the sill than the head jamb end, a bolt recess configured to receive the latch bolt of the latch assembly when the latch bolt is in its extended position, wherein the bolt recess is located between the head jamb end and the sill end, a head jamb side ramp comprising an inclined surface between the head jamb end and the bolt recess, wherein the inclined surface of the head jamb side ramp is closer to the first side of the sash at the bolt recess than at the head jamb end of the sash connector block, wherein, when the sash connector block moves along the first axis towards the head jamb with the latch bolt located between the head jamb end of the sash connector block and the head jamb, the inclined surface of the head jamb side ramp is configured to move the latch bolt from its extended position to its retracted position until the latch bolt reaches the bolt recess at which point the latch bolt moves to its extended position in the latch bolt recess, and a sill side ramp comprising an inclined surface between the sill end and the bolt recess, wherein the inclined surface of the sill side ramp is closer to the first side of the sash at the bolt recess than at the sill end of the sash connector block, wherein, when the sash connector block moves along the first axis towards the sill with the latch bolt located between the sill end of the sash connector block and the sill, the inclined surface of the sill side ramp is configured to move the latch bolt from its extended position to its retracted position until the latch bolt reaches the bolt recess at which point the latch bolt moves to its extended position in the latch bolt recess.

In another aspect, one or more embodiments of the windows described herein may include a window frame comprising first and second side jambs that are connected to each other by a head jamb and a sill; a sash movably mounted in the window frame and configured for movement between the first and second side jambs along a first axis aligned with the head jamb and the sill; a latch assembly attached to the sash, the latch assembly comprising a latch bolt movable between an extended position and retracted position, wherein the latch bolt is biased in the extended position in which the latch bolt extends away from the sash and wherein the latch bolt is movable from the extended position to the retracted position in which the latch bolt moves towards the sash; and a powered sash driving apparatus a motor and a linear actuator; a sash connector block operably connected to the linear actuator of the powered sash driving apparatus, wherein the powered sash driving apparatus is configured to move the sash connector block between the first side jamb and the second side jamb. In one or more embodiments, the sash connector block comprises: a first end and a second end, wherein the first end is closer to the first side jamb than the second end, and wherein the second end is closer to the second side jamb than the first end, a bolt recess configured to receive the latch bolt of the latch assembly when the latch bolt is in its extended position, wherein the bolt recess is located between the head jamb end and the sill end, a first ramp comprising an inclined surface between the first end and the bolt recess, wherein the inclined surface of the first ramp is closer to the sash at the bolt recess than at the first end of the sash connector block, and wherein, when the sash connector block moves along the first axis towards the first side jamb with the latch bolt located between the first end of the sash connector block and the first side jamb, the inclined surface of the first ramp is configured to move the latch bolt from its extended position to its retracted position until the latch bolt reaches the bolt recess at which point the latch bolt moves to its extended position in the latch bolt recess, and a second ramp comprising an inclined surface between the second end and the bolt recess, wherein the inclined surface of the second ramp is closer to the sash at the bolt recess than at the second end of the sash connector block, and wherein, when the sash connector block moves along the first axis towards the second side jamb with the latch bolt located between the second end of the sash connector block and the second side jamb, the inclined surface of the second ramp is configured to move the latch bolt from its extended position to its retracted position until the latch bolt reaches the bolt recess at which point the latch bolt moves to its extended position in the latch bolt recess.

In one or more embodiments of the windows described herein, the powered sash driving apparatus comprises a powered mode and unpowered mode, wherein the sash is coupled to the motor when the powered sash driving apparatus is in the powered mode such that operation of the motor moves the linear actuator which, in turn moves the sash connector block and the sash, and wherein the sash connector block and the sash are decoupled from the motor when the powered sash driving apparatus is in the unpowered mode. In one or more embodiments, the powered sash driving apparatus comprises a clutch between the motor and the linear actuator, and wherein the clutch is engaged when the powered sash driving apparatus is in the powered mode, and further wherein the clutch is disengaged when the powered sash driving apparatus is in the unpowered mode.

In one or more embodiments of the windows described herein, the powered sash driving apparatus is attached to one of the head jamb and the sill.

In one or more embodiments of the windows described herein, the powered sash driving apparatus is attached to the first side jamb.

In one or more embodiments of the windows described herein, the window balance apparatus comprises a torsion spring defining a passageway aligned with the first axis, and wherein at least a portion of the linear actuator extends through the passageway defined by the torsion spring. In one or more embodiments, the window balance apparatus comprises a tension spring.

In one or more embodiments of the windows described herein, the window balance apparatus comprises a tension spring defining a passageway aligned with the first axis, and wherein at least a portion of the linear actuator extends through the passageway defined by the tension spring. In one or more embodiments, the window balance apparatus comprises a torsion spring.

In another aspect, one or more embodiments of the methods of operably connecting a sash to a powered sash driving apparatus in a window frame as described herein may include: positioning a sash in the window frame, wherein the sash comprises a latch bolt that is biased towards an extended position in which the latch bolt extends away from the sash towards the frame, and wherein the latch bolt is movable from the extended position to a retracted position in which the latch bolt moves towards the sash; connecting a powered sash driving apparatus to the window frame, wherein the powered sash driving apparatus comprises a motor and a linear actuator operably connected to the motor; and moving a sash connector block in a first direction along a first axis using the linear actuator of the powered sash driving apparatus. In one or more embodiments, the sash connector block comprises: a first end and a second end, a bolt recess located between the first end and the second end of the sash connector block, the bolt recess configured to receive a latch bolt of a latch assembly when the latch bolt is in an extended position, a first ramp comprising an inclined surface between the first end and the bolt recess, wherein the inclined surface of the first ramp is closer to the sash at the bolt recess than at the first end of the sash connector block; and moving the latch bolt from the extended position towards the retracted position using the inclined surface of the first ramp as the sash connector block moves in the first direction along the first axis, wherein the latch bolt moves towards its extended position into the bolt recess when the latch bolt is aligned with the bolt recess, whereby the sash is operably connected to the powered sash driving system when the latch bolt is in the bolt recess.

In one or more embodiments of the methods described herein, the sash connector block further comprises a second ramp comprising an inclined surface between the second end and the bolt recess, wherein the inclined surface of the second ramp is closer to the sash at the bolt recess than at the second end of the sash connector block, and wherein the method further comprises moving the latch bolt from the extended position towards the retracted position using the inclined surface of the second ramp as the sash connector block moves in the second direction along the first axis, wherein the latch bolt moves towards its extended position into the bolt recess when the latch bolt is aligned with the bolt recess, whereby the sash is operably connected to the powered sash driving system when the latch bolt is in the bolt recess.

In one or more embodiments of the methods described herein, the powered sash driving apparatus comprises a powered mode and unpowered mode, and wherein the method further comprises: coupling the sash to the motor when the powered sash driving apparatus is in the powered mode such that operation of the motor moves the linear actuator which, in turn, moves the sash connector block and the sash within the window frame; and decoupling the sash from the motor when the powered sash driving apparatus is in the unpowered mode. In one or more embodiments, the powered sash driving apparatus comprises a clutch between the motor and the linear actuator, and wherein the method further comprises: engaging the clutch when the powered sash driving apparatus is in the powered mode; and disengaging the clutch when the powered sash driving apparatus is in the unpowered mode.

In one or more embodiments of the methods described herein, the sash moves horizontally within the window frame, and wherein the powered sash driving apparatus is attached to a head jamb or a sill of the window frame.

In one or more embodiments of the methods described herein, the sash moves vertically within the window frame, and wherein the powered sash driving apparatus is attached to a side jamb of the window frame, and further wherein a window balance apparatus is also operably connected to the sash. In one or more embodiments, the window balance apparatus comprises a torsion spring defining a passageway aligned with the first axis, and wherein at least a portion of the linear actuator extends through the passageway defined by the torsion spring. In one or more embodiments, the window balance apparatus comprises a tension spring.

In one or more embodiments of the methods described herein, the window balance apparatus comprises a tension spring defining a passageway aligned with the first axis, and wherein at least a portion of the linear actuator extends through the passageway defined by the tension spring. In one or more embodiments, the window balance apparatus comprises a torsion spring.

The above summary is not intended to describe each embodiment or every implementation of the windows and window balance assemblies or the methods described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1A:
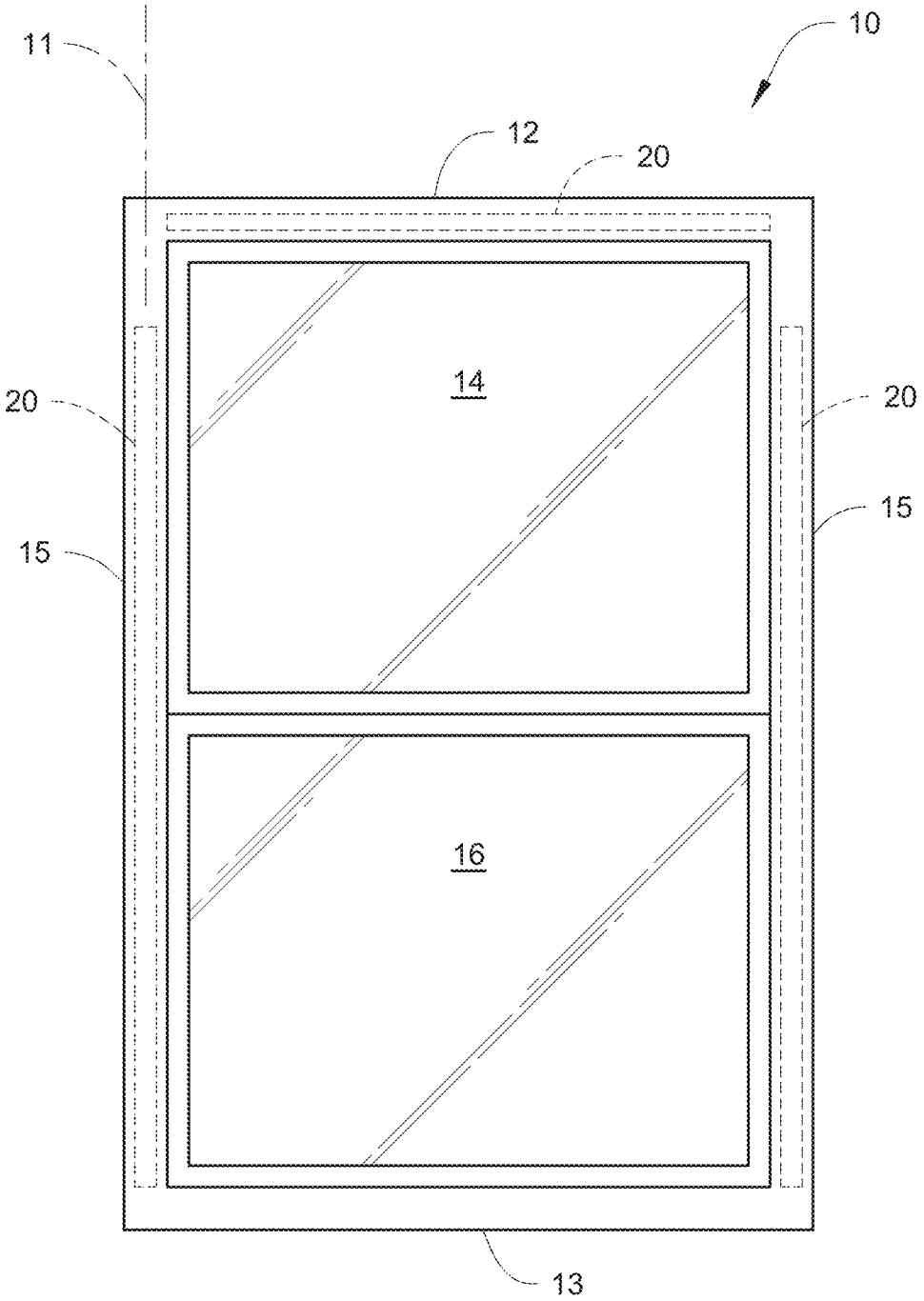
FIG. 1A depicts one illustrative embodiment of a window with a vertically moving sash incorporating a powered sash driving apparatus and connection block as described herein.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

One illustrative embodiment of a window 10 incorporating one or more window balance assemblies 20 is depicted in FIG. 1A. As used herein, the phrase "window balance assembly" and variations thereof means, in the case of windows including both a window balance apparatus and a powered sash driving apparatus, the combination of both the window balance apparatus and the powered sash driving apparatus as combined in a window 10.

The window 10 depicted in FIG. 1A includes a frame having a head jamb 12, a sill 13, and a pair of side jambs 15 that extend between the head jamb 12 and the sill 13. The window 10 further includes a first sash 14 and a second sash 16. If the window 10 is a double hung window, both sashes 14 and 16 will move between the head jamb 12 and the sill 13 between the side jambs 15. If the window 10 is a single hung window, only one of the sashes 14 and 16 will move between the head jamb 12 and the sill 13.

In the embodiment depicted in FIG. 1A, window balance assemblies 20 may be incorporated into one or more of the side jambs 15, the head jamb 12, and/or the sill 13, although in one or more embodiments, the window 10 may include a window balance assembly in only one location (e.g., one of the side jambs 15, the head jamb 12, or the sill 13). As described herein, although the window balance assemblies 20 may be described as incorporated into a jamb or any part of the frame, in one or more embodiments, the window balance assembly 20 may be attached on to a surface of a jamb or other part of the frame.

In addition, the window balance apparatus and the powered sash driving apparatus in the window balance assemblies 20 described herein may be aligned and/or arranged to apply a force to a sash that operates along an axis 11 which is, in one or more embodiments, aligned with the direction along which one or more of the sashes 14 and 16 in the window move.

Figure 1B:
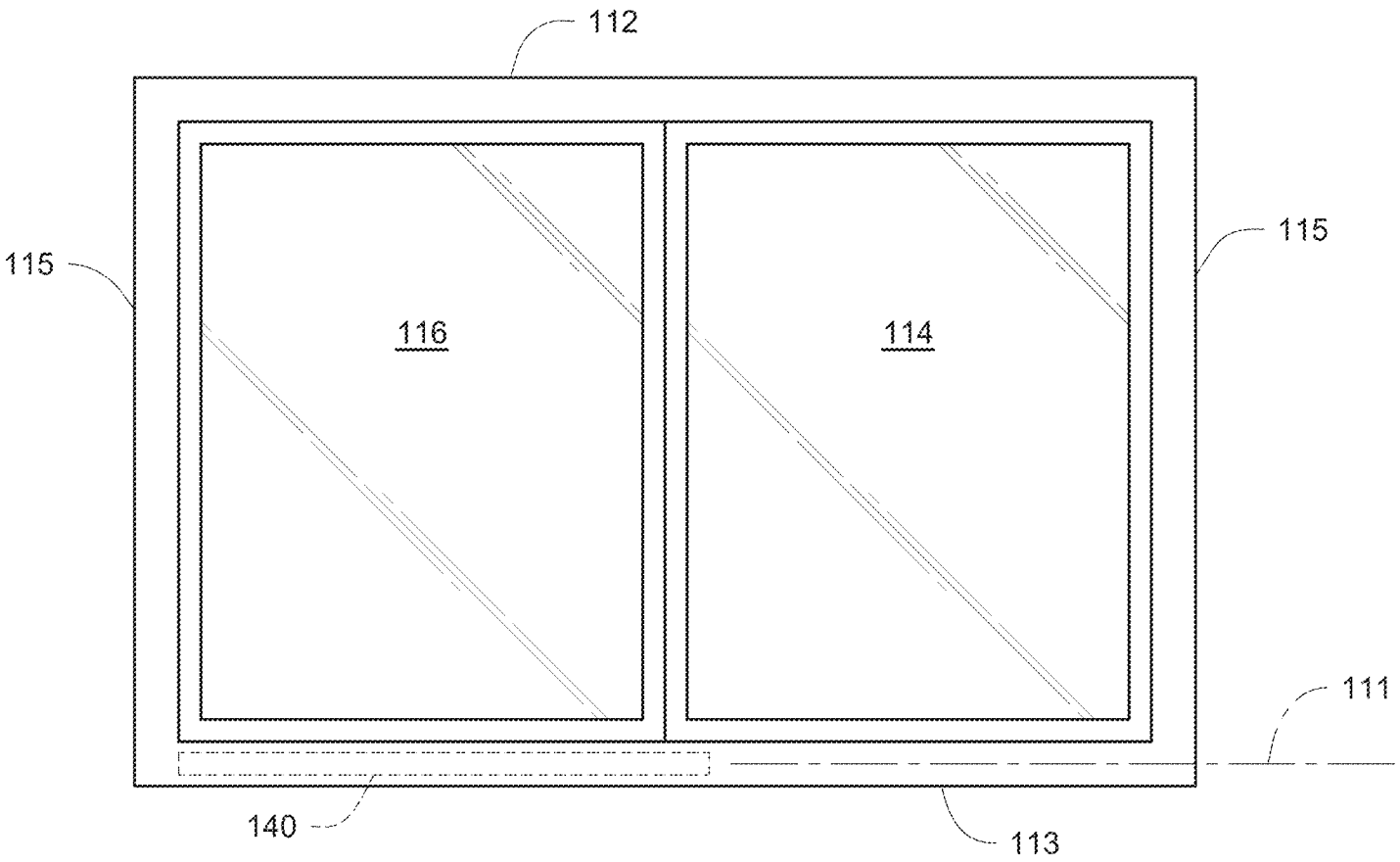
FIG. 1B depicts in the illustrative embodiment of a window with a horizontally moving sash incorporating a powered sash driving apparatus and connection block as described herein.

Another illustrative embodiment of a window 110 is depicted in FIG. 1B. The window 110 includes a head jamb 112, sill 113 and a pair of side jambs 115. Unlike the window 10 depicted in FIG. 1A, the window 110 includes a pair of sashes 114 and 116, at least one of which moves horizontally between the side jambs 115. Because movement of the sashes 114 and/or 116 does not require lifting of either sash, a window 110 in which one or more sashes move horizontally may not include a window balance apparatus. The window 110 of the embodiments described herein will, however, include a powered sash driving apparatus 140 that can be used to move one or both of the sashes 114 and 116 within the window frame formed by head jamb 112, sill 113 and side jambs 115.

Although the powered sash driving apparatus 140 is depicted as being located in the sill 113 below sash 116, the powered sash driving apparatus provided with windows in which one or more sashes move horizontally within the window frame may be located in any of the frame members. In the location in which powered sash having apparatus 140 is positioned, it may be particularly useful for moving sash 116 between the side jambs 115 as described herein.

Figure 2:
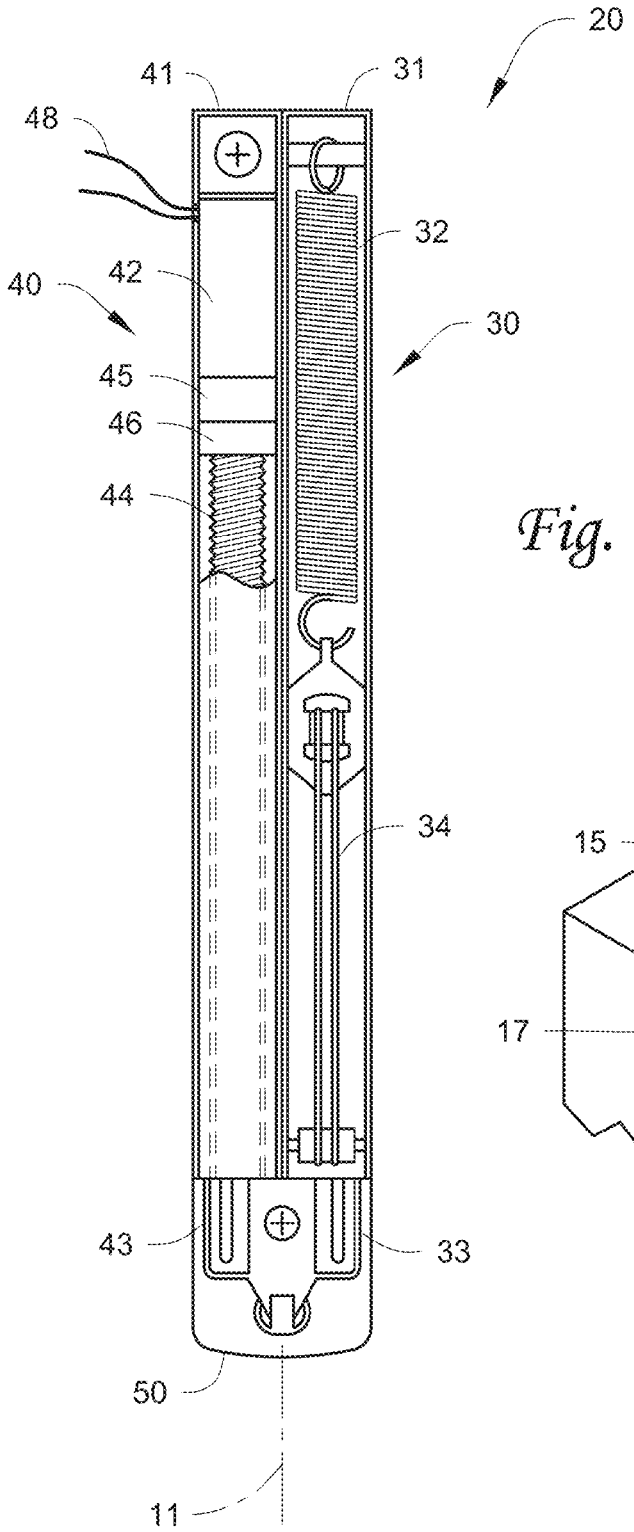
FIG. 2 depicts one illustrative embodiment of a window balance assembly including window balance apparatus and a powered sash driving apparatus that may be used in a window as described herein.
Figure 3:
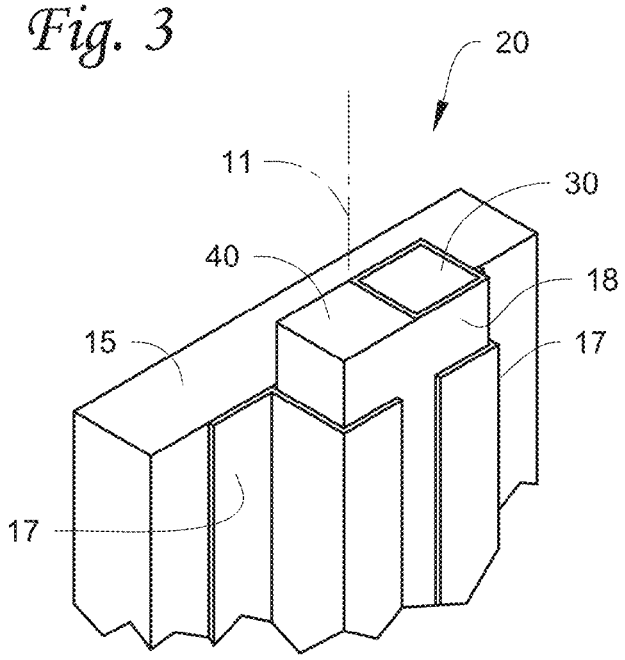
FIG. 3 is a perspective view of the window balance assembly in the form of a combination of a window balance apparatus and a powered sash driving apparatus as depicted in FIG. 2 mounted on a frame as described herein.

One illustrative embodiment of a window balance assembly 20 that may be used in connection with a single or double hung window as described herein is depicted in FIGS. 2 and 3. The window balance assembly 20 includes a window balance apparatus 30 and a powered sash driving apparatus 40. The window balance apparatus 30 and the powered sash driving apparatus 40 are, in the depicted embodiment, in a side-by-side arrangement, although many other arrangements may be possible. For example, in one or more embodiments, a pair of window balance apparatus may be combined on one side of a sash (if, e.g., the sash is larger than could be handled using a single window balance apparatus). In such an arrangement, a powered sash driving apparatus may be combined by, in one or more embodiments, extending the linear actuator between the pair of window balance apparatus. Many other combinations and/or arrangements of window balance apparatus and powered sash driving apparatus may also be used in the window balance assemblies described herein. In essence, one or more window balance apparatus may be combined with one or more powered sash driving apparatus in the window balance assemblies described herein.

The window balance apparatus 30 depicted in FIG. 2 includes a tension spring 32 and a block and tackle 34 as is conventionally known in the field of window balances. Although the interior components of the window balance apparatus 30 are visible in FIG. 2, the interior components of a window balance apparatus may or may not be visible in a finished product.

As used herein, a window balance apparatus assists and/or controls movement of a sash within a window through the gain and release of potential energy within one or more mechanical components. Although the window balance apparatus 30 depicted in FIG. 2 includes a tension spring 32 along with a block and tackle 34, other known window balance apparatus may use other components to assist with movement and/or control of a sash within a window. For example, other embodiments of window balances may use a tension spring, a torsion spring, the combination of a tension spring and a torsion spring, cables with weights, etc. Other types of window balance apparatus that may be combined with one or more powered sash driving apparatus to form a window balance assembly as described herein may include, e.g., clock spring balance apparatus, coil spring balance apparatus, spiral balance apparatus, etc. Examples of some conventional window balance apparatus that may be used in the window balance assemblies described herein may be described in, e.g., U.S. Pat. No. 5,152,032 (Davis et al.), U.S. Pat. No. 6,115,884 (DeJong et al.), U.S. Pat. No. 6,948,215 (Malek et al.), and U.S. Pat. No. 7,574,772 (Wellman et al.).

Furthermore, although the powered sash driving apparatus and the window balance apparatus used in the window balance assemblies described herein may be separated as seen in, e.g., FIG. 2, in one or more embodiments the powered sash driving apparatus may be incorporated into the window balance apparatus as seen in, e.g., FIG. 4. In the case of the embodiment of window balance assembly 20 of FIG. 2, the powered sash driving apparatus 40 may, in one or more embodiments, be incorporated into the window balance apparatus 30 by, e.g., extending the lead screw 44 of the linear actuator through the interior passageway defined by the tension spring 32 where the lead screw could, e.g., connect with the block and tackle 34 (or even extend through the block and tackle 34 in one or more embodiments).

The window balance apparatus 30 includes a first end 31 and a second end 33. The first end 31 is, in one or more embodiments, fixedly connected to a side jamb 15. As used herein, fixedly connected means that the first end 31 of the window balance apparatus 30 is fixed to the jamb in a way that does not allow the first end 31 of the window balance apparatus 30 move relative to the jamb. The window balance apparatus 30 is also operably connected to a sash at its second end 33 by any suitable technique. In the depicted embodiment, the window balance apparatus 30 and the powered sash driving apparatus 40 are both connected to the sash using a shoe 50. The use of shoes 50 to connect window balances to moving sash is in windows is known and will not be described further herein.

The window balance apparatus 30 is depicted in the retracted configuration in FIG. 2. In the extended configuration the shoe 50 would be moved downward away from the first end 31 of the window balance apparatus 30. Further, movement of a sash connected to the shoe 50 between a head jamb 12 and a sill 13 moves the window balance apparatus 30 between the retracted configuration and the extended configuration.

Also depicted in FIG. 2 is a powered sash driving apparatus 40 that includes a first end 41 and a second end 43. The first end 41 of the powered sash driving apparatus 40 is, in one or more embodiments, fixedly connected to a jamb to assist and/or control in the movement of a sash in a window. The powered sash driving apparatus 40 is also operably connected to a sash through its second end 43 which is, in the depicted embodiment, connected to the same shoe 50 to which the window balance apparatus 30 is connected (although a separate shoe may be used for the window balance apparatus 30 and the powered sash driving apparatus 40 in one or more alternative embodiments).

The window balance apparatus 30 and the powered sash driving apparatus 40 of the window balance assembly 20 are, in the depicted embodiment, connected to a sash using a shoe. In one or more alternative embodiments, however, the window balance apparatus and/or the powered sash driving apparatus of any window balance assembly as described herein may be attached to a sash by any suitable technique that may or may not involve a shoe. For example, the window balance apparatus and/or assemblies may connect to a sash using a tilt latch device as described herein or using any other point of attachment.

The powered sash driving apparatus 40 includes, in or more embodiments, a motor 42 and a linear actuator operably connected to the motor 42. The motor 42 may be, in one or more embodiments, an electric motor that receives power through wires 48. Operation of the motor 42 moves the linear actuator between a refracted configuration and an extended configuration. The powered sash driving apparatus 40 is depicted in the retracted configuration in FIG. 2. In the extended configuration the shoe 50 would be moved downward away from the first end 41 of the powered sash driving apparatus 40. Further, the powered sash driving apparatus 40 moves a sash to which the shoe 50 is connected between a head jamb 12 and a sill 13 when the linear actuator is moving between the retracted configuration and the extended configuration.

In the embodiment depicted in FIG. 2, the linear actuator is in the form of a lead screw 44 that is operably connected to the motor 42 in a manner that results in rotation of the lead screw 44 when the motor 42 is operated. Rotation of the lead screw 44 moves a follower 46 mounted on the lead screw 44 and the follower 46 extends downward to the second end 43 of the powered sash driving apparatus 40. As such, movement of the follower 46 moves the second end 43 which, in turn, moves the shoe 50 and a sash attached thereto. The linear actuators used in the powered sash driving apparatus described herein may include configurations other than a lead screw and follower. Other potentially suitable alternatives may include a rack and pinion, belt or chain drive, etc.

In one or more embodiments in which a lead screw is used as a part of the powered sash driving apparatus as described herein, rotation of the lead screw can be accomplished in any suitable manner. In one or more embodiments, the motor may be a conventional direct-current motor with a gearbox used to achieve the acquired speed and torque to move a sash. Quiet operation of the motor and associated components may, in one or more embodiments, be enhanced by the use of helical gears and/or vibration isolation of the motor and gearbox. In one or more embodiments, reversal of the motor direction for moving the sash in both directions within a window frame can be achieved by reversing the polarity of the direct-current power supplied to the motor.

Because the sashes in windows may be moved manually, in one or more embodiments the powered sash driving apparatus may allow for movement of the apparatus between its extended and retracted configurations when the motor is not powered, i.e., when the motor is not being used to move the sash.

To allow for manual movement of a sash, the powered sash driving apparatus 40 may, in one or more embodiments, include a powered mode and unpowered mode. In such an embodiment, the sash can be coupled to the motor 42 of the powered sash driving apparatus 40 when the powered sash driving apparatus 40 is in the powered mode. In the powered mode, operation of the motor 42 moves the linear actuator between the refracted and extended configurations and, as a result, the sash connected to the powered sash driving apparatus 40 between the head jamb 12 and the sill 13.

When the powered sash driving apparatus 40 is in the unpowered mode, the sash is decoupled from the motor 42 such that manual movement of the sash between the head jamb and the sill can move the linear actuator of the powered sash driving apparatus 40 between the retracted and extended configurations, preferably with little or no resistance offered by the powered sash driving apparatus 40.

In one or more embodiments, the motor 42 may be coupled and decoupled from a sash as described herein using a clutch 45 located between the lead screw 44 and the motor 42. The clutch 45 may be engaged when the powered sash driving apparatus 40 is in the powered mode such that operation of the motor results in rotation of the lead screw 44 and, thereby, movement of the follower 46. The clutch 45 is disengaged when the powered sash driving apparatus 40 is in the unpowered mode such that the follower 46 and/or lead screw 44 may rotate freely as the powered sash driving apparatus 40 is moved between its extended and refracted configurations as described herein.

FIG. 3 is a perspective view of the window balance assembly 20 mounted on a side jamb 15. The window balance assembly 20 includes both a window balance apparatus 30 and a powered sash driving apparatus 40 that are aligned with each other and with a first axis 11 that extends along the side jamb 15. In addition, a jamb liner 17 along with a shield 18 are also depicted in the illustrative embodiment of FIG. 3 and may be used to house and/or shield the window balance apparatus 30 and the powered sash driving apparatus 40. Although the window balance assembly 20 is shown as mounted on a surface of the side jamb 15, in one or more alternative embodiments, the window balance assembly 20 may be mounted within a cavity formed in a jamb or, in some instances, a two-piece jamb may be provided.

Figure 4A:
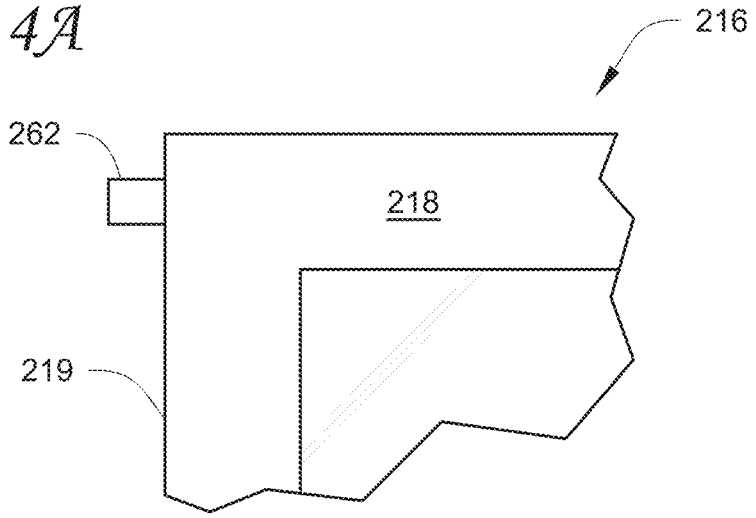
FIGS. 4A-4C depict one illustrative embodiment of a sash including a tilt latch assembly having a latch bolt as described herein.
Figure 4B:
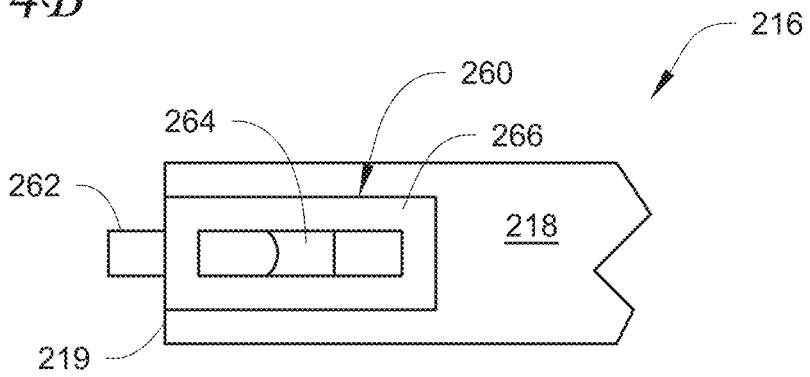
Figure 4C:
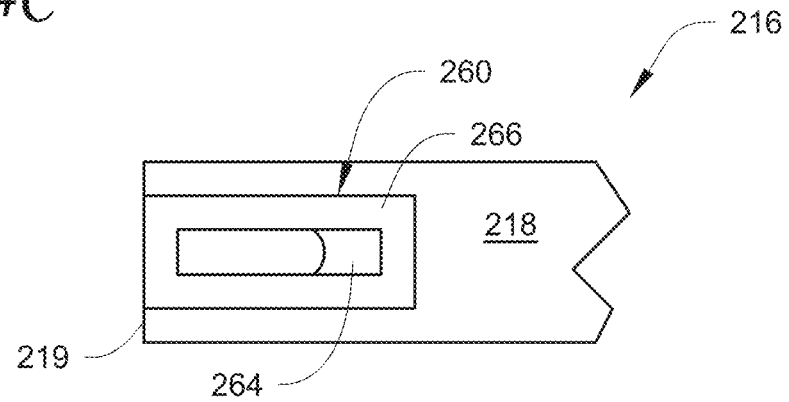

As discussed herein, the powered sash driving apparatus may be connected to a moving sash using, in one or more embodiments, a tilt latch assembly. One illustrative embodiment of a sash 216 incorporating a tilt latch assembly 260 is depicted in FIGS. 4A-4C. The tilt latch assembly 260 includes a latch bolt 262 that, in the depicted embodiment, is operably connected to an actuator 264 located in a housing 266 of the tilt latch assembly 260. The housing 266 of the tilt latch assembly 260 is located in or attached to a frame member 218 of the sash 216.

The latch bolt 262 of the tilt latch assembly 260 is movable between an extended position and a retracted position. In one or more embodiments, the latch bolt 262 may be biased in the extended position in which the latch bolt 262 extends away from the side 219 of the sash 216. In one or more embodiments, biasing of the latch bolt 262 in the extended position may be accomplished using a variety of different structures including, e.g., a spring or other resilient member.

The latch bolt 262 is depicted in an extended position in both of FIGS. 4A and 4B. Movement of the actuator 264 to the right as seen in, e.g., FIG. 4C, moves the latch bolt 262 to a retracted position such that the latch bolt 262 no longer extends away from the side 219 of the frame 218 of the sash 216 (or extends outwardly or away from the side 219 of the frame 218 over a shorter distance than when in the extended position). Typically, the actuator 264, when released, will move back leftward (as seen, e.g., in FIG. 4B), thus allowing the latch bolt 262 to return to its extended position.

Although the latch bolt 262 is provided as a part of a tilt latch assembly 260 in the embodiment depicted in FIGS. 4A-4C, in one or more alternative embodiments, a sash used in connection with the powered sash driving apparatus as described herein may include a latch bolt that is movable between an extended position and a retracted position that is not part of a tilt latch assembly. One such example of this variation may be seen in, e.g., a horizontally sliding sash which, as described herein, may include a latch assembly that includes a movable latch bolt but the latch assembly does not form part of a tilt latch assembly as that term is used in conventional double or single hung windows. Along those lines, although the latch bolt 262 is depicted as moving horizontally between its extended and retracted positions in FIGS. 4A-4C, in one or more embodiments, the latch assemblies in windows as described herein may include a latch bolt that moves vertically between its extended and retracted positions when the sash on which the latch assembly is used is moved in a horizontal direction by a powered sash driving apparatus as described herein.

Furthermore, although the latch bolt 262 is depicted as protruding from an upper left corner of the sash 216, in one or more embodiments, the latch bolts used in connection with the powered sash driving apparatus described herein may protrude from any suitable location on a sash to be moved using the powered sash driving apparatus. In other words, the illustrative embodiment is illustrative in nature only and should not be construed as limiting the location of a latch bolt on a sash.

Figure 5:
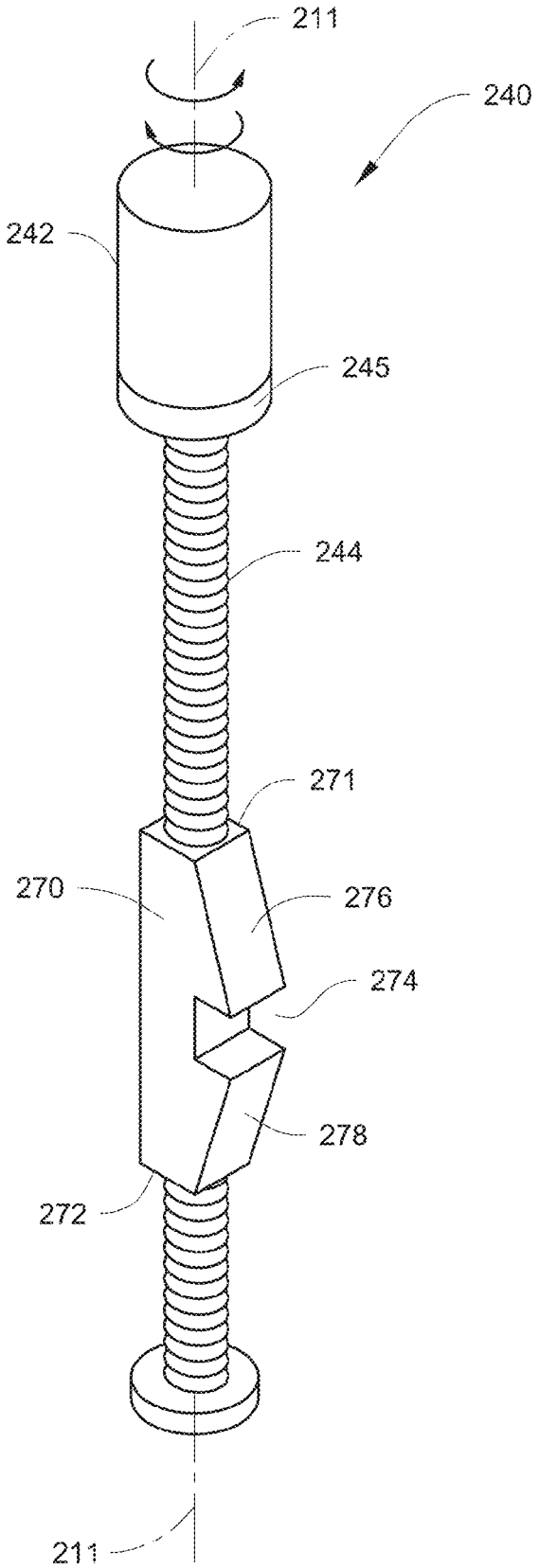
FIG. 5 depicts one illustrative embodiment of a powered sash driving apparatus including a motor, linear actuator and sash connector block as described herein.

One illustrative alternative embodiment of a powered sash driving apparatus 240 including a sash connector block 270 configured to operably connect to a latch bolt 262 on a sash 216 as described herein is depicted in FIG. 5. The powered sash driving apparatus 240 includes a motor 242 connected to a linear actuator 244 (in the form of a lead screw in the illustrated embodiment). The motor 242 is, in the depicted embodiment, connected to the linear actuator 244 through a clutch 245 such that the motor 242 may be coupled and decoupled from the linear actuator 244 as described herein. The motor 242 may, in one or more embodiments, rotate the linear actuator 244 about an axis 211.

Also depicted in connection with the powered sash driving apparatus 240 is a sash connector block 270 that is operably connected to the linear actuator 244. The powered sash driving apparatus 240 is configured to move the sash connector block 270 along the axis 211. In particular, rotation of the linear actuator 244 by the motor 242 will cause the sash connector block 270 to move towards or away from the motor 242 depending on the direction of rotation of the linear actuator 244. Where the linear actuator is in the form of a lead screw, the sash connector block 270 may include complementary threads that cooperate with the lead screw of linear actuator 244 to convert the rotational movement of the linear actuator 244 to translational motion such that the connector block 270 moves towards or away from the motor 242.

The sash connector block 270 includes a bolt recess 274 that is configured to receive the latch bolt 262 of a latch assembly 250 when the latch bolt 262 is in its extended position. The bolt recess 274 is located between a first end 271 and a second end 272 of the sash connector block 270.

Also included in one or more embodiments of a sash connector block 270 as described herein are a first ramp 276 and a second ramp 278. The first ramp 276 provides an inclined surface between the first end 271 and the bolt recess 274 of the sash connector block 270. The second ramp 278 provides an inclined surface between the second end 272 and the bolt recess 274 of the sash connector block 270.

The inclined surfaces of the first ramp 276 and the second ramp 278 provide a window incorporating a sash connector block, powered sash driving apparatus, and latch assembly with a latch bolt as described herein with the capability of reconnecting the sash carrying the latch bolt 262 with the sash connector block 270 when those two components are no longer operably connected to each other. Situations such as that may occur when, for example, it is desired to decouple the sash from the powered sash driving apparatus, replacing a sash within a window, etc.

Operation of one illustrative embodiment of a window including a latch assembly, a powered sash driving apparatus and a sash connector block as described herein to reconnect the latch bolt of a latch assembly with the connector block and, thus, reconnect the sash carrying the latch bolt to the powered sash driving apparatus by moving the sash connector block will be described in connection with FIGS. 6A-6C.

Figure 6A:
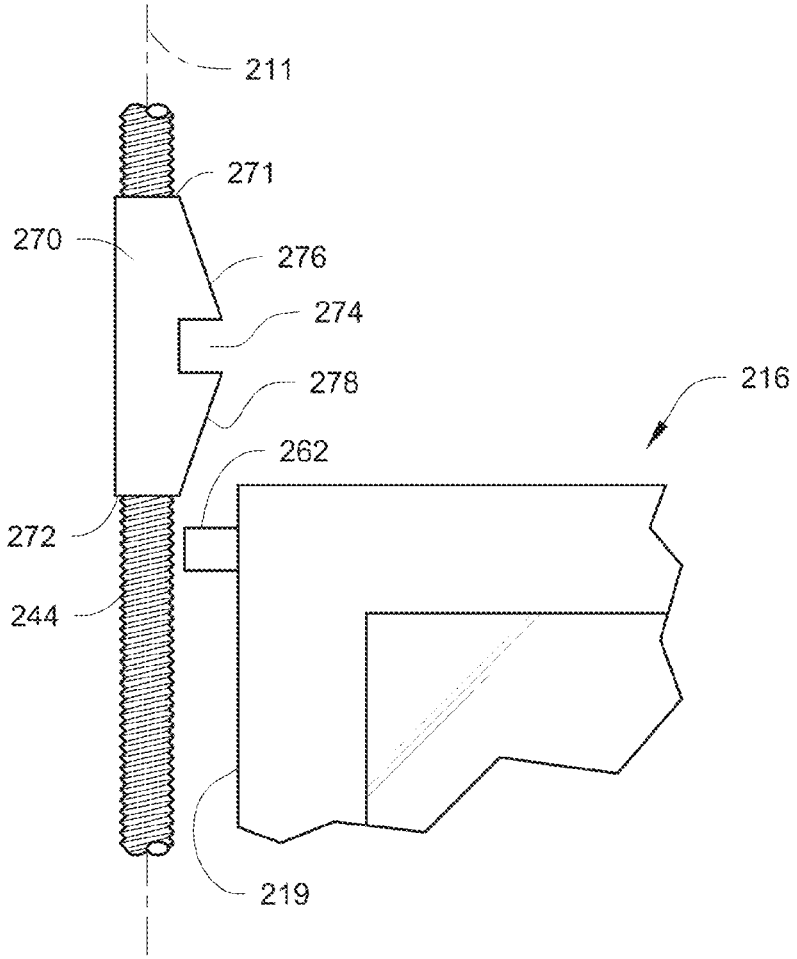
FIGS. 6A-6C depict one illustrative embodiment of reconnection of a sash to a sash connector block as described herein.

Referring to FIG. 6A, only those components necessary to describe the operation of re-coupling a sash 216 to a sash connector block 270 are depicted. In particular, the sash 216 includes a latch bolt 262 in an extended position with the latch bolt 262 extending away from the side 219 of the sash 216. The sash connector block 270 to which the latch bolt 262 is to be connected is depicted on a linear actuator 244 (in the form of a lead screw in the depicted embodiment). Rotation of the linear actuator 244 about axis 211 causes the connector block 270 to move along the linear actuator 244 in the direction of axis 211. In the depicted embodiment, the linear actuator 244 may be rotated such that the sash connector block 270 moves along the axis 211 in the direction towards the latch bolt 262.

As the bolt recess 274 of the sash connector block 270 approaches the latch bolt 262, the inclined surface of the second ramp 278 of the sash connector block 270 will, in one or more embodiments, cause the latch bolt 262 to move from its extended position towards its refracted position. In particular, the second ramp 278 may be described as having an inclined surface that is closer to the side 219 of the sash 216 at the bolt recess 274 than at the second end 272 of the sash connector block 270. Similarly, the first ramp may be described as having an inclined surface that is closer to the side 219 of the sash 216 at the bolt recess 274 than at the first end 271 of the sash connector block 270.

Figure 6B:
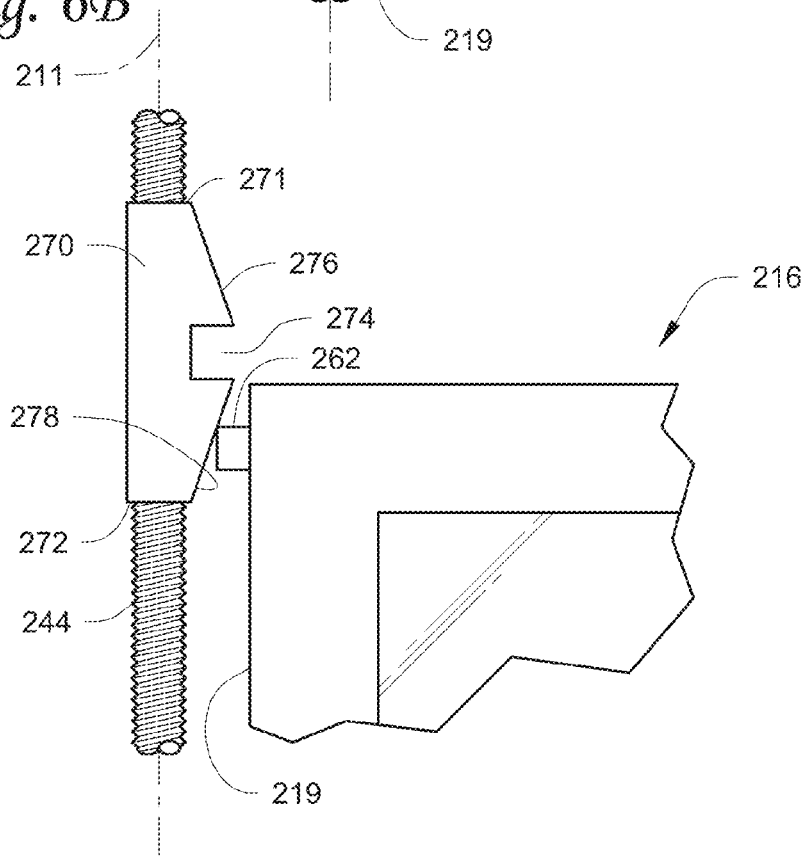

Referring to FIG. 6B, the latch bolt 262 is seen in an intermediate position between its extended position and its retracted position as the sash connector block 270 moves downward towards the sash 216 because the inclined surface of the second ramp 278 forces the latch bolt 262 towards the side 219 of the sash 216.

Figure 6C:
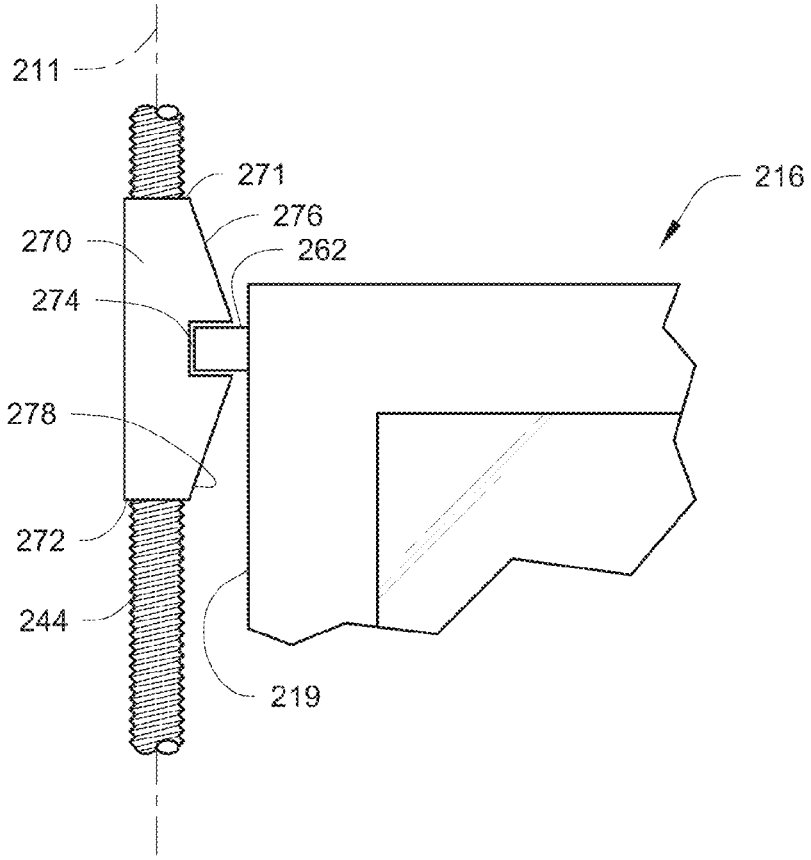

Further movement of the sash connector block 270 in the downward direction results in positioning the latch bolt 262 over the latch bolt recess 274 in the sash connector block 270 as seen in, e.g., FIG. 6C. Because the latch bolt 262 is biased in its extended position, the latch bolt 262 moves from its retracted position to its extended position such that the latch bolt 262 is located in the latch bolt recess 274 of the sash connector block 270. With the latch bolt 262 located in the latch bolt recess 274, movement of the sash connector block 270 along the axis 211 by the linear actuator 244 will cause corresponding movement of the sash 216 as the sash connector block 270 acts on the latch bolt 262.

Although not depicted in figures, it will be understood that the first side ramp 276 would perform similarly in combination with the latch bolt 262 if the connector block 270 approached the latch bolt 262 from the opposite direction (i.e., if the sash connector block 270 started below the latch bolt 262 and moved upward in the views as seen in FIGS. 6A-6C).

In one or more embodiments in which the sash connector block 270 is used in a double or single hung window, the first end 271 of the sash connector block 270 may be described as the head jamb end of the sash connector block 270 and the second end 272 of the sash connector block 270 may be described as the sill end of the sash connector block. Accordingly, the ramp formed by the inclined surface extending between the head jamb/first end 271 and the latch bolt recess 274 can be described as the head jamb side ramp of the sash connector block 270, while the ramp formed by the inclined surface extending between the sill/second end 272 and the latch bolt recess 274 can be described as the sill side ramp of the sash connector block 270.

Figure 7:
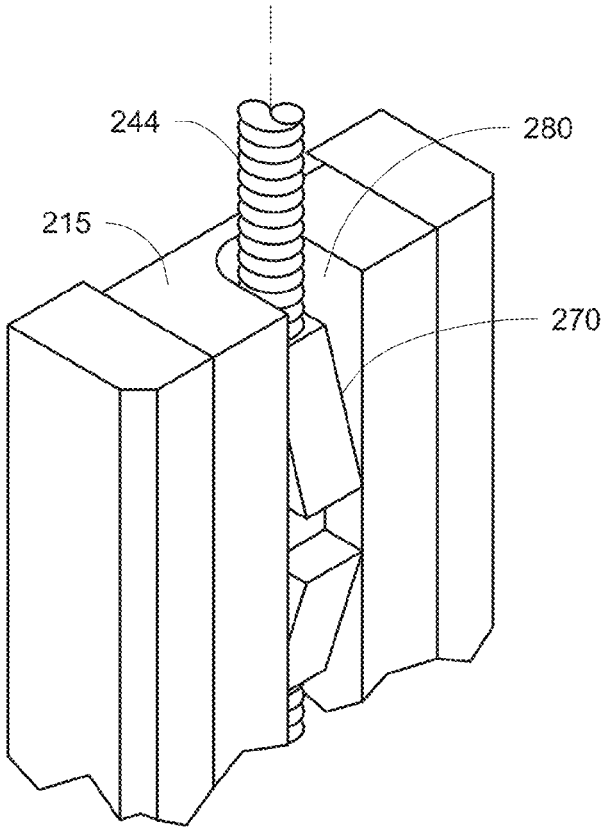
FIG. 7 depicts a linear actuator and sash connector block located within a frame member of a window as described herein.

A perspective view of the linear actuator 244 along with the sash connector block 270 located in a channel 280 formed in a frame member 215 is depicted in FIG. 7. In one or more embodiments, the frame member 215 may be a side jamb if the window in which the linear actuator 244 and sash connector block 270 are provided is a single or double hung window in which the sash connector block 270 moves vertically along with a sash. In one or more alternative embodiments, the frame member 215 may be a sill or a head jamb if the window in which the linear actuator 244 and sash connector block 270 are provided is a window in which a sash moves horizontally, e.g., a gliding window, etc.

Figure 8:
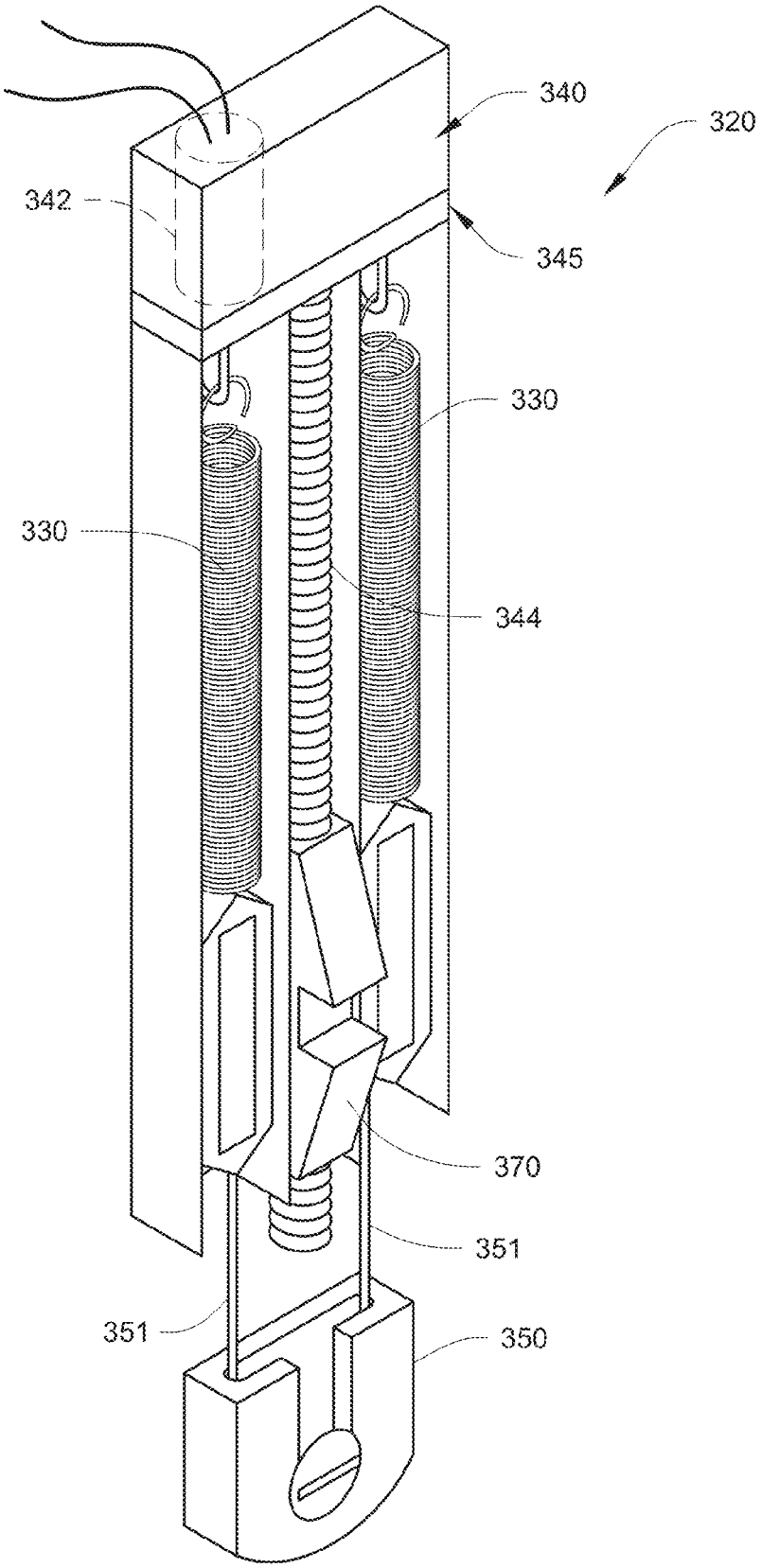
FIG. 8 is a perspective view of another illustrative embodiment of a window balance assembly including a pair of window balance apparatus and a powered sash driving apparatus as described herein.

Another illustrative embodiment of a window balance assembly 320 that may be used in connection with a single or double hung window as described herein is depicted in FIG. 8. The window balance assembly 320 includes a pair of window balance apparatus 330 and a powered sash driving apparatus 340. In the embodiment depicted in FIG. 8, the powered sash driving apparatus 340 is located between the pair of window balance apparatus 330 in a side-by-side arrangement, although many other arrangements may be possible as discussed herein.

The window balance apparatus 330 depicted in FIG. 8 each include a tension spring and a block and tackle, although other known window balance apparatus may use other components to assist with movement and/or control of a sash within a window as described herein. The window balance apparatus 330 are both connected to a shoe 350 through lift cords 351. The shoe 350 is configured for attachment to a moving sash within a window and, as a result, the window balance apparatus 330 are configured for attachment to a moving sash within a window. The use of shoes to connect window balances to moving sash is in windows is known and will not be described further herein.

Also depicted in FIG. 8 is a powered sash driving apparatus that includes a motor 342 connected to a linear actuator 344 through an optional clutch 345 as described herein. A sash connector block 370 is operably connected to the lead screw 344 such that rotation of the lead screw moves the sash connector block 370 towards or away from the motor 342 as described herein. In the illustrative embodiment depicted in FIG. 8, the powered sash driving apparatus is not connected to the sash using the same shoe 350 that is used to connect the window balance apparatus 330 to the sash. Rather, the powered sash driving apparatus depicted in FIG. 8 is configured for attachment to a sash using a latch bolt as described herein.

Figure 9:
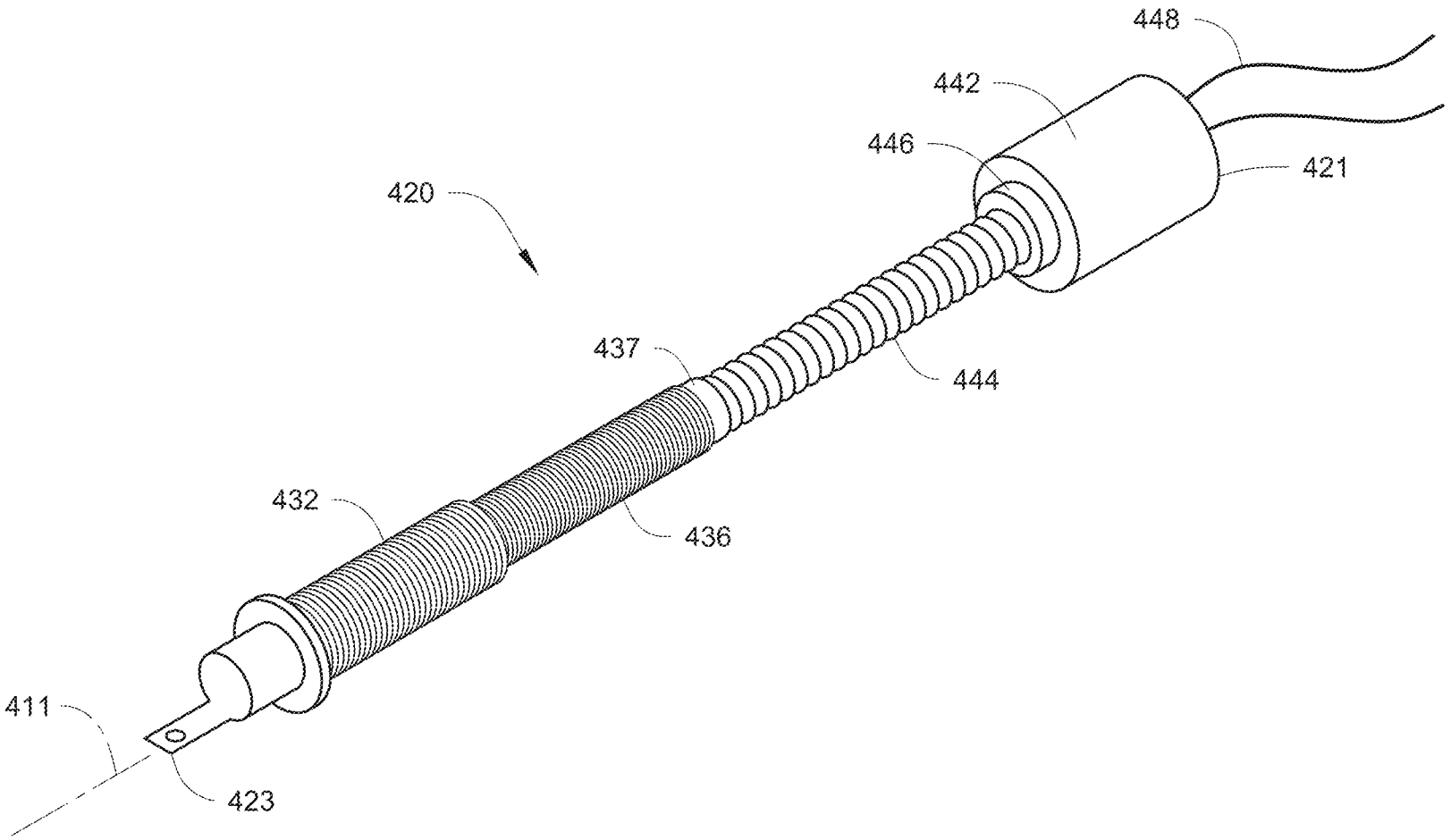
FIG. 9 is a perspective view of one illustrative embodiment of an alternative window balance assembly that integrates a window balance apparatus with a powered sash driving apparatus as described herein.

A perspective view of one illustrative embodiment of an alternative window balance assembly 420 is depicted in FIG. 9. The window balance assembly 420 includes components that may be associated with both a window balance apparatus and components that may be associated with a powered sash driving apparatus as described herein.

The illustrative embodiment of a window balance assembly 420 depicted FIG. 9 includes, as components of a window balance apparatus, a tension spring 432 and a torsion spring 436. These springs act to store and release potential energy as a window sash is moved within a window. Many of the patent documents identified herein described various embodiments of spring based window balance apparatus and their specific construction and details regarding their operational not be repeated here. Although the window balance apparatus of window balance assembly 420 includes both a tension spring 432 and a torsion spring 436, in one or more embodiments, the window balance apparatus of the window balance assembly 420 may include only one spring, i.e., either a tension spring or a torsion spring.

The window balance assembly 420 depicted in FIG. 9 also includes components of a powered sash driving apparatus. In particular, those components include a motor 442 and a linear actuator that, in the depicted embodiment, includes a lead screw 444 and a follower 446. The motor 442 may receive electrical energy through leads 448 also depicted in FIG. 9. The lead screw 444 may, in one or more embodiments, extend into a passageway formed in the torsion spring 436. That passageway within the torsion spring 436 may, in one or more embodiments, the aligned with the axis 411.

Further, the storage and release of potential energy through the winding of torsion spring 436 may be affected using a follower 437 that may in one or more embodiments act on the threads of the lead screw 444. Further, in one or more embodiments, the follower 437 may also serve as the follower for the powered operation of the window balance apparatus 420.

The window balance assembly 420 also includes, in one or more embodiments, a first end 421 and a second end 423. The first end 421 of the window balance assembly 420 is, in one or more embodiments, fixedly connected to a jamb to assist and/or control in the movement of a sash in a window. The window balance assembly 420 is also operably connected to a sash through its second end 423 which may be, as described herein, connected to a shoe which is, in turn, connected to a window sash.

The powered sash driving apparatus as described herein can, in one or more embodiments, include a controller operably connected to the motor or motors of the powered sash driving apparatus and other components to provide variety of features and functions above and beyond the ability to operate in two directions to open and close a sash. The controllers used in the powered sash driving apparatus described herein may be provided in any suitable form and may, for example, include memory and a controller. The controller may, for example, be in the form of one or more microprocessors, Application Specific Integrated Circuit (ASIC) state machines, etc. The controllers may include one or more of any suitable input devices configured to allow a user to operate the apparatus (e.g., keyboards, touchscreens, mice, remote controls, etc.), as well as display devices configured to convey information to a user (e.g., display screens (which may or may not be touchscreens), indicator lights, etc.).

For example, in one or more embodiments, the controller of a powered sash driving apparatus as described herein may be configured to monitor the electric current drawn by a motor in a powered sash driving apparatus. Monitoring the electric current drawn by the motor may provide the controller with the ability to detect obstructions in the path of the sash and/or to set end points of the travel distance. This may be useful where, for example, the sash connector block is disconnected from the sash. In such a situation, the powered sash driving apparatus may not have an indication as to where the sash is located within a window frame. As a result, it may be useful to operate the powered sash driving apparatus such that the sash connector block connects with the sash and moves the sash to either a fully open or fully closed position with detection of either the fully open or fully closed positions being based on the electric current being drawn by the motor of the powered sash driving apparatus described herein.

In one or more embodiments, the windows and powered sash driving apparatus used in them as described herein may include position sensing features to enable the sash to be stopped at one or more predetermined positions within a window frame. One potential technique for position sensing may include a controller that is configured to count rotations or steps of rotation of the motor or other rotating component (e.g., a lead screw) as one way of determining position within a window as described herein. Setting a sash at a predetermined position may allow a system to provide predetermined opening in a window that provides ventilation while improving safety and security by limiting the size of that opening.

In one or more embodiments of the powered sash driving apparatus as described herein, the apparatus may include a controller that is configured to provide a reengage mode which could be used after a sash has been disengaged from a sash connector block (e.g., the latch bolt has been removed from the bolt recess of the sash connector block). If the sash has been moved to a position in which the latch bolt is no longer aligned with the bolt recess of a sash connector block (to, e.g., enable manual operation of a sash within a window frame), the powered sash driving apparatus can be placed into a reengage mode in which the sash connector block will be moved until the sash connector block reaches and re-engages with the latch bolt on a sash, thus returning the sash to powered operation using the powered sash driving apparatus. Re-engagement of a latch bolt and sash connector block as described herein may, in one or more embodiments, be determined by monitoring the motor of a powered sash driving apparatus for an increase in current draw which would be indicative of a load placed on the motor by movement of a sash after re-engagement.

In one or more embodiments, the powered sash driving apparatus described herein may include a controller that is configured to provide a manual mode in which, after a sash connector block has been disengaged from a latch bolt on a sash, the sash connector block may be moved to a position out of the range of travel of the latch bolt to allow movement of the sash to various positions within a window frame without inadvertently re-engaging the latch bolt with the sash connector block.

In one or more embodiments, a controller in the powered sash driving apparatus may be configured to provide feedback to a user or to a another system in the form of, e.g., an indication of sash position (which may be expressed as high and/or width of an opening in inches or other units, a percent or fraction of total opening, etc.). In one or more embodiments, the controller may be further configured to provide feedback in the form of a comment or warning that a sash is in a position in a window that may be unsafe (e.g., open, etc.), may not comply with a code requirement, etc.

In one or more embodiments, a controller in the powered sash driving apparatus may be configured to provide an indication of whether or not a sash connector block is engaged with a latch bolt on a sash. The system may be able to detect such a condition because, when a sash connector block is not engaged with a latch bolt on a sash, movement of the sash connector block by the powered sash driving apparatus would result in a lower current drawn by the motor of the powered sash driving apparatus as compared to the current drawn by the motor if the sash connector block was engaged with the latch bolt on a sash. In one or more embodiments, a controller in the powered sash driving apparatus could be configured to provide a warning or other indication that sash opening and closing is no longer under the control of the powered sash driving apparatus if it is determined that the latch bolt on the sash is not engaged with the sash connector block of the powered sash driving apparatus.

In one or more embodiments, a powered sash driving apparatus as described herein may also include additional sensors in communication with a controller of the powered sash driving apparatus to determine the sash position within a window frame relative to the sash connector blocks when the powered sash driving apparatus is no longer in engagement with the latch bolt on a sash.

In still other embodiments, a powered sash driving apparatus as described herein may further include additional sensors in communication with a controller of the powered sash driving apparatus such as, e.g., proximity sensors, etc., to sense obstructions in the path of a moving sash to halt movement of the sash and, in some instances, reverse movement of the sash to reduce the possibility of injury.

The complete disclosure of any patents, patent documents, and publications identified herein are incorporated by reference in their entirety as if each were individually incorporated.

Illustrative embodiments of the window balance assemblies and windows incorporating them, as well as related methods, are discussed and reference has been made to possible variations. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. A window comprising:

a window frame comprising first and second side jambs that are connected to each other by a head jamb and a sill;

a sash movably mounted in the window frame, the sash positioned between the first and second side jambs and configured for movement between the head jamb and the sill along a first axis aligned with the first and second side jambs;

a latch assembly attached to a first side of the sash, wherein the first side of the sash is adjacent to and moves along the first side jamb, wherein the latch assembly comprises a latch bolt movable between an extended position and retracted position, wherein the latch bolt is biased in the extended position in which the latch bolt extends away from the first side of the sash towards the first side jamb and wherein the latch bolt is movable from the extended position to the retracted position in which the latch bolt moves towards the first side jamb; and a window balance apparatus configured to counteract the weight of the sash during movement of the sash between the head jamb and the sill;

a powered sash driving apparatus comprising a motor and a linear actuator;

a sash connector block operably connected to the linear actuator of the powered sash driving apparatus, wherein the powered sash driving apparatus is configured to move the sash connector block along the first side jamb between the head jamb and the sill;

wherein the sash connector block comprises:

a head jamb end and a sill end, wherein the head jamb end is closer to the head jamb than the sill end and wherein the sill end is closer to the sill than the head jamb end, a bolt recess configured to receive the latch bolt of the latch assembly when the latch bolt is in its extended position, wherein the bolt recess is located between the head jamb end and the sill end, a head jamb side ramp comprising an inclined surface between the head jamb end and the bolt recess, wherein the inclined surface of the head jamb side ramp is closer to the first side of the sash at the bolt recess than at the head jamb end of the sash connector block, wherein, when the sash connector block moves along the first axis towards the head jamb with the latch bolt located between the head jamb end of the sash connector block and the head jamb, the inclined surface of the head jamb side ramp is configured to move the latch bolt from its extended position to its retracted position until the latch bolt reaches the bolt recess at which point the latch bolt moves to its extended position in the latch bolt recess, and a sill side ramp comprising an inclined surface between the sill end and the bolt recess, wherein the inclined surface of the sill side ramp is closer to the first side of the sash at the bolt recess than at the sill end of the sash connector block, wherein, when the sash connector block moves along the first axis towards the sill with the latch bolt located between the sill end of the sash connector block and the sill, the inclined surface of the sill side ramp is configured to move the latch bolt from its extended position to its retracted position until the latch bolt reaches the bolt recess at which point the latch bolt moves to its extended position in the latch bolt recess;

wherein the powered sash driving apparatus is operably connected to the sash and configured to move the sash along the first side jamb between the head jamb and the sill only when the latch bolt is in the extended position in the bolt recess of the sash connector block;

and wherein the window balance apparatus is connected to the sash and configured to counteract the weight of the sash during movement of the sash between the head jamb and the sill whether or not the latch bolt is in the extend position in the bolt recess of the sash connector block.

2. A window according to claim 1, wherein the powered sash driving apparatus comprises a powered mode and unpowered mode, wherein the sash is coupled to the motor through the linear actuator and the sash connector block when the powered sash driving apparatus is in the powered mode such that operation of the motor moves the linear actuator which, in turn moves the sash connector block and the sash only when the latch bolt is in the extended position in the bolt recess of the sash connector block, and wherein the sash connector block and the sash are decoupled from the motor when the powered sash driving apparatus is in the unpowered mode such that the sash can be manually moved between the head jamb and the sill when the powered sash driving apparatus is in the unpowered mode.

3. A window according to claim 2, wherein the powered sash driving apparatus comprises a clutch between the motor and the linear actuator, and wherein the clutch is engaged when the powered sash driving apparatus is in the powered mode, and further wherein the clutch is disengaged when the powered sash driving apparatus is in the unpowered mode.

4. A window according to claim 1, wherein the powered sash driving apparatus is attached to the first side jamb.

5. A window comprising:

a window frame comprising first and second side jambs that are connected to each other by a head jamb and a sill;

a sash movably mounted in the window frame and configured for movement between the first and second side jambs along a first axis aligned with the head jamb and the sill;

a latch assembly attached to the sash, the latch assembly comprising a latch bolt movable between an extended position and retracted position, wherein the latch bolt is biased in the extended position in which the latch bolt extends away from the sash and wherein the latch bolt is movable from the extended position to the retracted position in which the latch bolt moves towards the sash; and a powered sash driving apparatus comprising a motor and a linear actuator;

a sash connector block operably connected to the linear actuator of the powered sash driving apparatus, wherein the powered sash driving apparatus is configured to move the sash connector block between the first side jamb and the second side jamb;

wherein the sash connector block comprises:

a first end and a second end, wherein the first end is closer to the first side jamb than the second end, and wherein the second end is closer to the second side jamb than the first end, a bolt recess configured to receive the latch bolt of the latch assembly when the latch bolt is in its extended position, wherein the bolt recess is located between the first end and the second end, a first ramp comprising an inclined surface between the first end and the bolt recess, wherein the inclined surface of the first ramp is closer to the sash at the bolt recess than at the first end of the sash connector block, and wherein, when the sash connector block moves along the first axis towards the first side jamb with the latch bolt located between the first end of the sash connector block and the first side jamb, the inclined surface of the first ramp is configured to move the latch bolt from its extended position to its retracted position until the latch bolt reaches the bolt recess at which point the latch bolt moves to its extended position in the latch bolt recess, and a second ramp comprising an inclined surface between the second end and the bolt recess, wherein the inclined surface of the second ramp is closer to the sash at the bolt recess than at the second end of the sash connector block, and wherein, when the sash connector block moves along the first axis towards the second side jamb with the latch bolt located between the second end of the sash connector block and the second side jamb, the inclined surface of the second ramp is configured to move the latch bolt from its extended position to its retracted position until the latch bolt reaches the bolt recess at which point the latch bolt moves to its extended position in the latch bolt recess;

wherein the powered sash driving apparatus is operably connected to the sash and configured to move the sash along the first axis between the first side jamb and the second side jamb only when the latch bolt is in the extended position in the bolt recess of the sash connector block;

and further wherein the sash is configured for movement along the first axis whether or not the latch bolt is in the extended position in bolt recess of the sash connector block.

6. A window according to claim 5, wherein the powered sash driving apparatus comprises a powered mode and unpowered mode, wherein the sash is coupled to the motor through the linear actuator and the sash connector block when the powered sash driving apparatus is in the powered mode such that operation of the motor moves the linear actuator which, in turn moves the sash connector block and the sash only when the latch bolt is in the extended position in the bolt recess of the sash connector block, and wherein the sash connector block and the sash are decoupled from the motor when the powered sash driving apparatus is in the unpowered mode such that the sash can be manually moved between the first side jamb and the second side jamb when the powered sash driving apparatus is in the unpowered mode.

7. A window according to claim 6, wherein the powered sash driving apparatus comprises a clutch between the motor and the linear actuator, and wherein the clutch is engaged when the powered sash driving apparatus is in the powered mode, and further wherein the clutch is disengaged when the powered sash driving apparatus is in the unpowered mode.

8. A window according to claim 5, wherein the powered sash driving apparatus is attached to one of the head jamb and the sill.

9. A window according to claim 1, wherein the linear actuator comprises a lead screw.

10. A window according to claim 1, wherein the window balance apparatus comprises a tension spring.

11. A window according to claim 1, wherein the window balance apparatus comprises a torsion spring.

12. A window according to claim 5, wherein the linear actuator comprises a lead screw.

* * * * *